US010239182B2

(12) United States Patent
Jian et al.

(10) Patent No.: US 10,239,182 B2
(45) Date of Patent: Mar. 26, 2019

(54) POLISHING PAD AND POLISHING METHOD

(71) Applicant: IV Technologies CO., Ltd., Taichung (TW)

(72) Inventors: Yi Jian, Taichung (TW); Wen-Chang Shih, Taichung (TW); Kun-Che Pai, Taichung (TW); Chin-Chih Chen, Nantou County (TW)

(73) Assignee: IV Technologies CO., Ltd., Taichung (TW)

( * ) Notice: Subject to any disclaimer, the term of this patent is extended or adjusted under 35 U.S.C. 154(b) by 12 days.

(21) Appl. No.: 15/610,629

(22) Filed: Jun. 1, 2017

(65) Prior Publication Data

US 2017/0355061 A1 Dec. 14, 2017

(30) Foreign Application Priority Data

Jun. 8, 2016 (TW) ..... 105118264 A

(51) Int. Cl.

| | |
|---|---|
| ***B24B 49/12*** | (2006.01) |
| ***B24B 37/24*** | (2012.01) |
| ***B24B 37/20*** | (2012.01) |
| ***B24B 37/013*** | (2012.01) |

(52) U.S. Cl.
CPC ..... *B24B 37/205* (2013.01); *B24B 37/013* (2013.01); *B24B 49/12* (2013.01)

(58) Field of Classification Search
CPC ..... B24B 49/12; B24B 37/24; B24B 37/22; B24B 37/20
USPC ..... 451/6, 41, 526, 527, 533, 534
See application file for complete search history.

(56) References Cited

U.S. PATENT DOCUMENTS

| | | | | |
|---|---|---|---|---|
| 6,458,014 | B1 * | 10/2002 | Ihsikawa | B24B 37/013 451/287 |
| 2005/0148183 | A1 * | 7/2005 | Shiro | B24B 37/205 438/692 |
| 2014/0357170 | A1 * | 12/2014 | Qian | B24B 37/205 451/527 |
| 2016/0107290 | A1 | 4/2016 | Bajaj et al. | |
| 2017/0120417 | A1 * | 5/2017 | Lefevre | B24B 37/22 |

FOREIGN PATENT DOCUMENTS

| | | |
|---|---|---|
| CN | 1639848 | 7/2005 |
| TW | 511174 | 11/2002 |
| TW | 200414965 | 8/2004 |
| TW | 200539987 | 12/2005 |
| TW | 200724303 | 7/2007 |
| TW | 201143985 | 12/2011 |
| TW | 201400235 | 1/2014 |
| TW | 201615341 | 5/2016 |

OTHER PUBLICATIONS

Office Action of China Counterpart Application, dated on Nov. 26, 2018, pp. 1-7.

* cited by examiner

*Primary Examiner* — Robert Rose
(74) *Attorney, Agent, or Firm* — JCIPRNET

(57) ABSTRACT

A polishing pad is provided. The polishing pad includes a polishing layer and a detection window. The detection window is disposed in the polishing layer. The modulus of the detection window is larger than the modulus of the polishing layer at 30° C., and the modulus of the detection window is smaller than the modulus of the polishing layer at 50° C.

15 Claims, 3 Drawing Sheets

POLISHING PAD AND POLISHING METHOD

CROSS-REFERENCE TO RELATED APPLICATION

This application claims the priority benefit of Taiwan application serial no. 105118264, filed on Jun. 8, 2016. The entirety of the above-mentioned patent application is hereby incorporated by reference herein and made a part of this specification.

BACKGROUND OF THE INVENTION

1. Field of the Invention

The invention relates to a polishing pad and a polishing method. More particularly, the invention relates to a polishing pad having a detection window and a polishing method using of the polishing pad.

2. Description of Related Art

Nowadays, in a manufacturing process of a device in the industry, the polishing process is a type of technology used commonly in achieving planarization for the surface of the object to be polished. In the polishing process, the object and the polishing pad are relatively moved, and the slurry is selectively provided between the surface of the object and the polishing pad for polishing.

For polishing equipment with an optical detection system, the polishing layer of the polishing pad is generally equipped with a detection window. When polishing is performed on the object by using the polishing pad, a user may detect polishing of the object through the detection window by the optical detection system of the polishing equipment, and the detection may serve as end-point detection of the polishing process. Generally, the material of the polishing layer and the material of the detection window are different. Thereby, it is one of the important issues for researchers in this field to study how to provide a polishing pad having a detection window, wherein the bonding between the detection window and the polishing pad is good, such that the polishing pad has longer usage life-span, and the detection window may not easily cause defects on the object being polished during a polishing process.

SUMMARY OF THE INVENTION

The invention provides a polishing pad suitable for polishing an object, and the polishing pad has favorable usage life-span and may not easily cause defects on an object being polished during a polishing process.

A polishing pad provided by the embodiments of the invention includes a polishing layer and a detection window. The detection window is disposed in the polishing layer, and the modulus of the detection window is larger than the modulus of the polishing layer at 30° C., and the modulus of the detection window is smaller than the modulus of the polishing layer at 50° C.

A polishing pad provided by the embodiments of the invention includes a polishing layer and a detection window. The detection window is disposed in the polishing layer, and the ratio of the modulus of the polishing layer to the modulus of the detection window at 50° C. is greater than or equal to 1.4.

A polishing pad provided by the embodiments of the invention includes a polishing layer and a detection window. The detection window is disposed in the polishing layer, and the ratio of the modulus of the detection window at 50° C. to the modulus of the detection window at 30° C. is less than or equal to 0.5.

A polishing method provided by the embodiments of the invention is suitable for polishing an object, and the polishing method includes following steps. First, the polishing pad is provided. Next, a pressure is applied to the object to press the object onto the polishing pad. Afterwards, the object and the polishing pad are relatively moved.

In view of the foregoing, the polishing pad provided by the embodiments of the invention includes the polishing layer and the detection window, and the modulus of the detection window at 30° C., the modulus of the detection window at 50° C., the modulus of the polishing layer at 30° C., and the modulus of the polishing layer at 50° C. have specific numerical relationships, such that the polishing pad provided by the embodiments of the invention is suitable for polishing an object, has favorable usage life-span, and may not easily cause defects on the object being polished when the polishing process is performed on the object.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
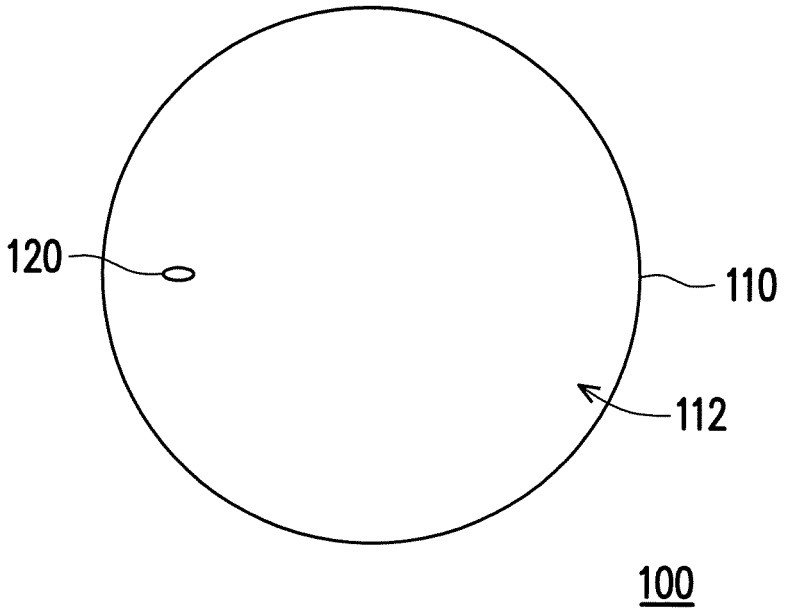
FIG. 1 is a schematic top view of a polishing pad according to an embodiment of the invention.
Figure 2:
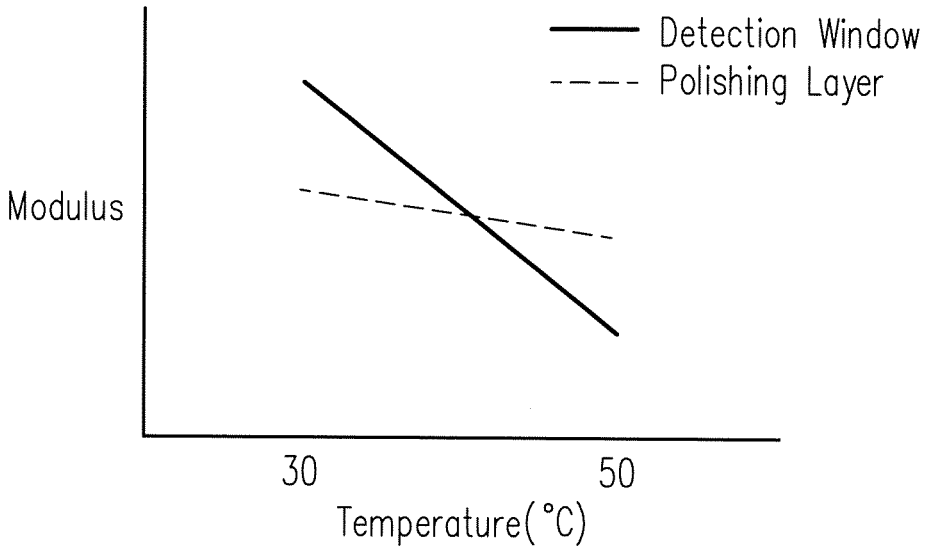
FIG. 2 is a schematic chart showing relationship between temperature and modulus of a polishing layer and a detection window according to an embodiment of the invention.
Figure 3:
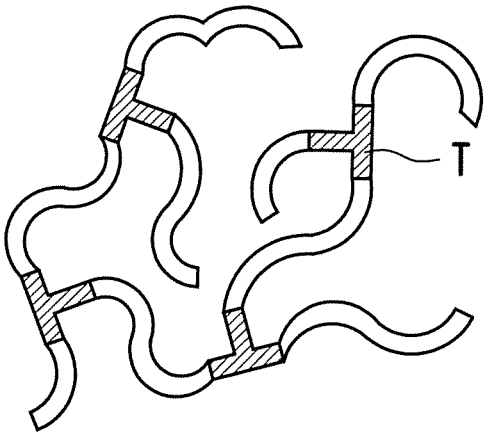
FIG. 3 is a schematic diagram of a molecular structure of a polishing layer according to an embodiment of the invention.
Figure 4:
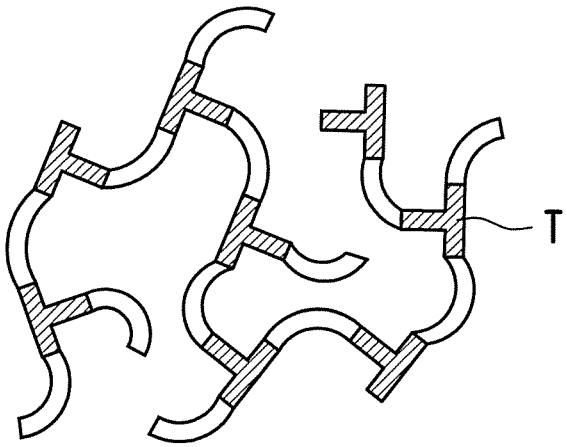
FIG. 4 is a schematic diagram of a molecular structure of a detection window according to an embodiment of the invention.

FIG. 1 is a schematic top view of a polishing pad according to an embodiment of the invention. FIG. 2 is a schematic chart showing relationship between temperature and modulus of a polishing layer and a detection window according to an embodiment of the invention. FIG. 3 is a schematic diagram of a molecular structure of a polishing layer according to an embodiment of the invention. FIG. 4 is a schematic diagram of a molecular structure of a detection window according to an embodiment of the invention.

Referring to FIG. 1, a polishing pad 100 includes a polishing layer 110 and a detection window 120 located in the polishing layer 110. Specifically, referring to FIG. 2, in the embodiment, the modulus of the detection window 120 is larger than the modulus of the polishing layer 110 at 30° C., and the modulus of the detection window 120 is smaller than the modulus of the polishing layer 110 at 50° C. Generally, the temperature reaches 50° C. during a polishing process performed on an object by using the polishing pad.

Thereby, in the embodiments, the temperature of 50° C. is defined as a state during which the polishing process is performed, and the temperature of 30° C. is defined as a state prior to the polishing process. In addition, in the embodiments, the modulus is defined as stress divided by strain. The unit of the modulus is MPa (just numerical values are presented in following description with no unit included). In other words, in the embodiment, in the state prior to the polishing process, the mechanical strength of the detection window 120 is greater than the mechanical strength of the polishing layer 110, and in the state during which the polishing process is performed, the mechanical strength of the detection window 120 is less than the mechanical strength of the polishing layer 110. From another aspect, in the embodiment, as temperature changes, properties of the detection window 120 and the polishing layer 110 change as well, and a level of change of the detection window 120 is greater than a level of change of the polishing layer 110.

Besides, in an embodiment, the ratio of the modulus of the polishing layer 110 to the modulus of the detection window 120 at 50° C. is greater than or equal to 1.4. In other words, in the state during which the polishing process is performed, the mechanical strength of the detection window 120 is significantly less than the mechanical strength of the polishing layer 110. In addition, in another embodiment, the ratio of the modulus of the detection window 120 at 50° C. to the modulus of the detection window 120 at 30° C. is less than or equal to 0.5. In other words, compared to the polishing layer 110, the mechanical strength of the detection window 120 is more significantly reduced as temperature rises.

Specifically, in an embodiment, the modulus of the detection window 120 at 30° C. ranges from 200 to 800 (e.g., from 400 to 700), and the modulus of the detection window 120 at 50° C. ranges from 50 to 200 (e.g., from 70 to 150). The modulus of the polishing layer 110 at 30° C. ranges from 200 to 700 (e.g., from 300 to 600), and the modulus of the polishing layer 110 at 50° C. ranges from 100 to 500 (e.g., from 150 to 400). But the invention is not limited thereto.

It is worth noting that since the modulus of the detection window 120 is larger than the modulus of the polishing layer 110 at 30° C., and the modulus of the detection window 120 is smaller than the modulus of the polishing layer 110 at 50° C., not only is the bonding between the detection window 120 and the polishing pad 100 good, such that the polishing pad 100 has favorable usage life-span, but when the polishing process is performed by using the polishing pad 100, the polishing pad 100 may not easily cause defects on the object being polished. On the contrary, if the modulus of the detection window 120 is larger than the modulus of the polishing layer 110 at 50° C., when the polishing process is performed on the object by using the polishing pad 100, the detection window 120 with relatively greater mechanical strength would protrude from the polishing layer 110 and easily cause defects on the object being polished, for instance, the object being polished is scratched by the detection window 120 during the polishing process; moreover, if the modulus of the detection window 120 is smaller than the modulus of the polishing layer 110 at 30° C., the bonding between the detection window 120 and the polishing pad 100 is not good, so that the leakage of the slurry may occur easily at a bonding interface to affect the usage life-span of the polishing pad 100 when the polishing process is repeatedly performed by using the polishing pad 100. It is worth noting that a bonding site of the detection window 120 in the polishing pad 100 is not limited, for instance, the detection window 120 is bonded with the polishing layer 110 in the polishing pad 100, or the detection window 120 is bonded with a buffer layer (not shown) below the polishing layer 110 in the polishing pad 100. The bonding methods include, for example, the adhering method, the fusing method, the structure fixing method, the method of curing into an integral body, or other suitable bonding methods, but the invention is not limited thereto.

In addition, in the embodiment, the material of the polishing layer 110 includes, for example, crosslinking polymer, and the material of the detection window 120 includes, for example, transparent crosslinking polymer. Furthermore, referring to FIG. 3 and FIG. 4, in the embodiment, compared to the lengths of chain segments between crosslinking sites T in the molecular structure of the crosslinking polymer of the polishing layer 110, the lengths of chain segments between crosslinking sites T in the molecular structure of the crosslinking polymer of the detection window 120 is shorter. From another aspect, in the embodiment, compared to the molecular mass Mc between the crosslinking sites T in the molecular structure of the crosslinking polymer of the polishing layer 110, the molecular mass Mc between the crosslinking sites T in the molecular structure of the crosslinking polymer of the detection window 120 is smaller. In an embodiment, the molecular mass Mc between the crosslinking sites T in the molecular structure of the crosslinking polymer of the polishing layer 110 ranges from 500 to 1000, and the molecular mass Mc between the crosslinking sites T in the molecular structure of the crosslinking polymer of the detection window 120 is less than 500, but the invention is not limited thereto.

Specifically, in the embodiment, the crosslinking polymer of the polishing layer 110 may be polyester, polyether, polyurethane, polycarbonate, polyacrylate, polybutadiene, or other suitable polymer formed by thermosetting resin or thermoplastic resin, and the crosslinking polymer of the detection window 120 may be thermoset plastics, thermoplastic, polycarbonate, polyester, polyurethanes, nylon, or acrylic polymers, but the invention is not limited thereto. Besides, in addition to the crosslinking polymer, the polishing layer 110 may further include conductive materials, polishing particles, micro-spheres, or other additives which may be dissolved in the crosslinking polymer.

It is worth noting that compared to the lengths of the chain segments between the crosslinking sites T in the molecular structure of the polishing layer 110, the lengths of the chain segments between the crosslinking sites T in the molecular structure of the detection window 120 is shorter, such that the modulus of the detection window 120 is larger than the modulus of the polishing layer 110 at 30° C., and the modulus of the detection window 120 is smaller than the modulus of the polishing layer 110 at 50° C. Thereby, the bonding between the detection window 120 and the polishing pad 100 is good, such that the polishing pad 100 has longer usage life-span, and the polishing pad 100 may not easily cause defects on the object being polished.

In addition, in the embodiment, the polishing layer 110 has a polishing surface 112. Specifically, when the polishing process is performed on the object by using the polishing pad 100, the object is in contact with the polishing surface 112. In addition, people having ordinary skill in the art should know that the polishing surface 112 includes a groove pattern even though the groove pattern is not shown in FIG. 1. The groove pattern may have various types of pattern distributions, such as a concentric ring, a non-concentric ring, an elliptical ring, a wavy ring, an irregular ring, multiple lines, parallel lines, radiant lines, radiant arcs, a spiral, a polyangular cell, or a combination thereof, but the invention is not limited thereto.

Besides, the detection window 120 is illustrated as an elliptical shape in FIG. 1, but the invention is not limited thereto. In other embodiments, the detection window 120 may be designed into various other shapes, such as a spindle, a circle, a rectangle, or any suitable shapes, based on actual requirement.

Besides, the number of the detection window 120 in FIG. 1 is illustrated as one, but the invention is not limited thereto. In other embodiments, the number of the detection window 120 may be plural based on actual requirement.

Figure 5:
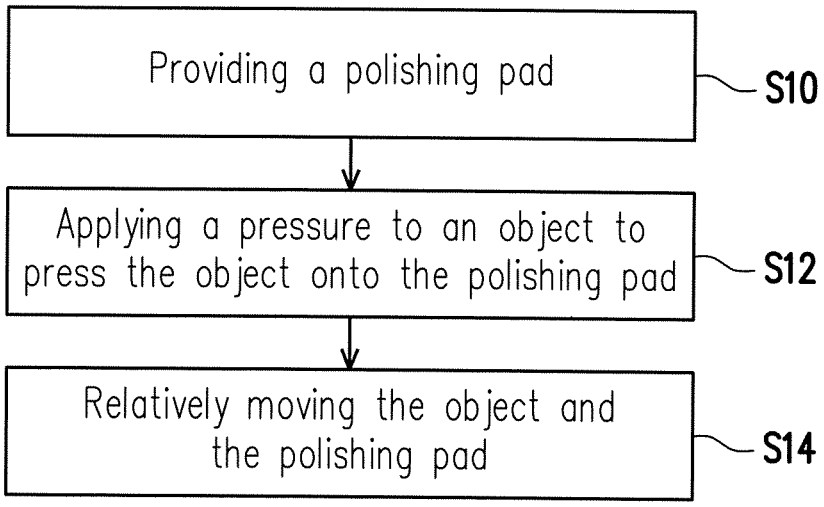
FIG. 5 is a flowchart of a polishing method according to an embodiment of the invention.

FIG. 5 is a flowchart of a polishing method according to an embodiment of the invention. The polishing method is suitable for polishing an object. Specifically, the polishing method may be applied to polishing processes for manufacturing an industrial device, such as a device used in the electronic industries, including semiconductor devices, integrated circuits, micro-electromechanical devices, energy conversion devices, communication devices, optical devices, disks for storage, and displays etc., and the objects used for manufacturing the devices may include semiconductor wafers, Group III-V wafers, storage device carriers, ceramic substrates, polymer substrates and glass substrates, but the invention is not limited thereto.

Referring to FIG. 5, first, the polishing pad 100 provided by any of the embodiments is provided in step S10. Relevant description of the polishing pad 100 is provided above in details and thus will not be further elaborated.

Next, in step S12, a pressure is applied to the object, such that the object is pressed onto the polishing pad 100 and is in contact with the polishing pad 100. Specifically, the object is in contact with the polishing surface 112 of the polishing layer 110 as described above. Besides, the method to apply a pressure on the object is performed by, for example, using a carrier capable of holding the object.

Afterwards, in step S14, the object and the polishing pad 100 are relatively moved to perform the polishing process on the object by using the polishing pad 100, such that the purpose of planarization is achieved. Specifically, the object and the polishing pad 100 are relatively moved by rotating a platen to drive the polishing pad 100 fixed on the platen to rotate, for example.

It is worth noting that as described above, since in the polishing pad 100, the modulus of the detection window 120 at 30° C., the modulus of the detection window 120 at 50° C., the modulus of the polishing layer 110 at 30° C., and the modulus of the polishing layer 110 at 50° C. have specific numerical relationships, the bonding between the detection window 120 and the polishing pad 100 is good, such that the polishing pad 100 used in the polishing method has longer usage life-span, and the polishing pad 100 is less likely to cause defects on the object being polished during the polishing process.

The features of the invention are more specifically described in the following with reference to Example 1 to Example 3 and Comparative Example 1 to Comparative Example 4. Although the following examples are described, the materials used, amount and ratio thereof, manufacturing details, and manufacturing process . . . etc., can be suitably modified without exceeding the scope of the invention. Accordingly, restrictive interpretation should not be made to the invention based on the examples described below.

The moduli of the polishing pads in Example 1 to Example 3 and conventional polishing pads in Comparative Example 1 to Comparative Example 4 at 30° C. and 50° C. are measured and recorded in Table 1. Specifically, in the polishing pads of Example 1 to Example 3, the molecular masses Mc between the crosslinking sites in the molecular structures of the crosslinking polymers of the polishing layers range from 500 to 1000, and the molecular masses Mc between the crosslinking sites in the molecular structures of the crosslinking polymers of the detection windows are less than 500; the conventional polishing pad in Comparative Example 1 and the conventional polishing pad in Comparative Example 2 are respectively polishing pad VP5000 and polishing pad IC1010 manufactured by Dow Chemical Company; the conventional polishing pad in Comparative Example 3 and the conventional polishing pad in Comparative Example 4 are respectively polishing pad D100 and polishing pad E150 manufactured by Cabot Microelectronics Corporation.

TABLE 1

| | Detection Window | | Polishing Layer | |
|---|---|---|---|---|
| | 30° C. | 50° C. | 30° C. | 50° C. |
| Example 1 | 614 | 87 | 592 | 395 |
| Example 2 | 515 | 109 | 374 | 259 |
| Example 3 | 326 | 130 | 312 | 186 |
| Comparative Example 1 | 872 | 480 | 426 | 236 |
| Comparative Example 2 | 649 | 445 | 342 | 243 |
| Comparative Example 3 | 140 | 89 | 361 | 76 |
| Comparative Example 4 | 143 | 88 | 341 | 119 |

As shown in Table 1, at 30° C., the modulus of the detection window in Example 1 is 614, the modulus of the detection window in Example 2 is 515, the modulus of the detection window in Example 3 is 326, the modulus of the polishing layer in Example 1 is 592, the modulus of the polishing layer in Example 2 is 374, and the modulus of the polishing layer in Example 3 is 312. It means that for the polishing pad of each of Example 1 to Example 3, when the temperature is at 30° C., the modulus of the detection window is larger than the modulus of the polishing layer. And, as shown in Table 1, at 50° C., the modulus of the detection window in Example 1 is 87, the modulus of the detection window in Example 2 is 109, the modulus of the detection window in Example 3 is 130, the modulus of the polishing layer in Example 1 is 395, the modulus of the polishing layer in Example 2 is 259, and the modulus of the polishing layer in Example 3 is 186. It means that for the polishing pad of each of Example 1 to Example 3, when the temperature is at 50° C., the modulus of the detection window is smaller than the modulus of the polishing layer. In other words, in the polishing pad of each of Example 1 to Example 3, the bonding between the detection window and the polishing pad is good, such that the polishing pad has longer usage life-span, and the polishing pad may not easily cause defects on the object being polished during the polishing process.

In addition, as shown in Table 1, at 50° C., the ratio of the modulus of the polishing layer to the modulus of the detection window in Example 1 is 4.54, the ratio of the modulus of the polishing layer to the modulus of the detection window in Example 2 is 2.38, and the ratio of the modulus of the polishing layer to the modulus of the detection window in Example 3 is 1.43. It means that for the polishing pad of each of Example 1 to Example 3, the ratio of the modulus of the polishing layer to the modulus of the detection window is greater than or equal to 1.4 when the temperature is at 50° C. In addition, as shown in Table 1, the ratio of the modulus of the detection window at 50° C. to the modulus of the detection window at 30° C. in Example 1 is 0.14, the ratio of the modulus of the detection window at 50° C. to the modulus of the detection window at 30° C. in Example 2 is 0.21, and the ratio of the modulus of the detection window at 50° C. to the modulus of the detection window at 30° C. in Example 3 is 0.40. It means that for each of Example 1 to Example 3, the ratio of the modulus of the detection window at 50° C. to the modulus of the detection window at 30° C. is smaller than or equal to 0.5.

On the contrary, as shown in Table 1, for the conventional polishing pad of each of Comparative Example 1 and Comparative Example 2, the modulus of the detection window (Comparative Example 1 is 480, Comparative Example 2 is 445) is larger than the modulus of the polishing layer (Comparative Example 1 is 236, Comparative Example 2 is 243) when the temperature is at 50° C. As such, when the polishing process is performed on the object by using the polishing pad, the detection window with relatively greater mechanical strength would protrude from the polishing layer to easily cause defects on the object being polished. Besides, for the conventional polishing pads in Comparative Example 1 and Comparative Example 2, when the temperature is at 50° C., the ratio of the modulus of the polishing layer to the modulus of the detection window in Comparative Example 1 is 0.49 and the ratio of the modulus of the polishing layer to the modulus of the detection window in Comparative Example 2 is 0.55. In addition, for the conventional polishing pads in Comparative Example 1 and Comparative Example 2, the ratio of the modulus of the detection windows at 50° C. to the modulus of the detection window at 30° C. in Comparative Example 1 is 0.55 and the ratio of the modulus of the detection windows at 50° C. to the modulus of the detection window at 30° C. in Comparative Example 2 is 0.69.

In addition, as shown in Table 1, for the conventional polishing pad of each of Comparative Example 3 and Comparative Example 4, when the temperature is at 30° C., the modulus of the detection window (Comparative Example 3 is 140, Comparative Example 4 is 143) is smaller than the modulus of the polishing layer (Comparative Example 3 is 361, Comparative Example 4 is 341). As such, the bonding between the detection window and the polishing pad is not good, so that the leakage of the slurry may occur easily at the bonding interface to affect the usage life-span of the polishing pad when the polishing process is repeatedly performed by using the polishing pad. Besides, for the conventional polishing pads in Comparative Example 3 and Comparative Example 4, when the temperature is at 50° C., the ratio of the modulus of the polishing layer to the modulus of the detection window in Comparative Example 3 is 0.85 and the ratio of the modulus of the polishing layer to the modulus of the detection window in Comparative Example 4 is 1.35. In addition, for the conventional polishing pads in Comparative Example 3 and Comparative Example 4, the ratio of the modulus of the detection window at 50° C. to the modulus of the detection window at 30° C. in Comparative Example 3 is 0.64 and the ratio of the modulus of the detection window at 50° C. to the modulus of the detection window at 30° C. in Comparative Example 4 is 0.62.

In addition, as shown in Table 1, for the conventional pad in Comparative Example 3, the modulus of the detection window is smaller than the modulus of the polishing layer when the temperature is at 30° C., such that the bonding between the detection window and the polishing pad is not good, and thereby usage life-span of the polishing pad is affected; besides, the modulus of the detection window (89) is larger than the modulus of the polishing layer (76) when the temperature is at 50° C., such that when the polishing process is performed on the object by using the polishing pad, the detection window with relatively greater mechanical strength would protrude from the polishing layer and easily cause defects on the object being polished during the polishing process.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A polishing pad, comprising:

a polishing layer; and a detection window, disposed in the polishing layer, wherein a modulus of the detection window is larger than a modulus of the polishing layer at 30° C., and the modulus of the detection window is smaller than the modulus of the polishing layer at 50° C.

2. The polishing pad as claimed in claim 1, wherein the modulus of the detection window at 30° C. ranges from 200 MPa to 800 MPa, and the modulus of the detection window at 50° C. ranges from 50 MPa to 200 MPa.

3. The polishing pad as claimed in claim 1, wherein the modulus of the polishing layer at 30° C. ranges from 200 MPa to 700 MPa, and the modulus of the polishing layer at 50° C. ranges from 100 MPa to 500 MPa.

4. The polishing pad as claimed in claim 1, wherein a molecular mass Mc between crosslinking sites in a molecular structure of the polishing layer ranges from 500 to 1000, and a molecular mass Mc between crosslinking sites in a molecular structure of the detection window is less than 500.

5. A polishing pad, comprising:

a polishing layer; and a detection window, disposed in the polishing layer, wherein a ratio of a modulus of the polishing layer to a modulus of the detection window at 50° C. is greater than or equal to 1.4.

6. The polishing pad as claimed in claim 5, wherein the modulus of the detection window at 30° C. ranges from 200 MPa to 800 MPa, and the modulus of the detection window at 50° C. ranges from 50 MPa to 200 MPa.

7. The polishing pad as claimed in claim 5, wherein the modulus of the polishing layer at 30° C. ranges from 200 MPa to 700 MPa, and the modulus of the polishing layer at 50° C. ranges from 100 MPa to 500 MPa.

8. The polishing pad as claimed in claim 5, wherein a molecular mass Mc between crosslinking sites in a molecular structure of the polishing layer ranges from 500 to 1000, and a molecular mass Mc between crosslinking sites in a molecular structure of the detection window is less than 500.

9. A polishing pad, comprising:

a polishing layer; and a detection window, disposed in the polishing layer, wherein a ratio of a modulus of the detection window at 50° C. to the modulus of the detection window at 30° C. is less than or equal to 0.5.

10. The polishing pad as claimed in claim 9, wherein the modulus of the detection window at 30° C. ranges from 200 MPa to 800 MPa, and the modulus of the detection window at 50° C. ranges from 50 MPa to 200 MPa.

11. The polishing pad as claimed in claim 9, wherein a modulus of the polishing layer at 30° C. ranges from 200 MPa to 700 MPa, and the modulus of the polishing layer at 50° C. ranges from 100 MPa to 500 MPa.

12. The polishing pad as claimed in claim 9, wherein a molecular mass Mc between crosslinking sites in a molecular structure of the polishing layer ranges from 500 to 1000, and a molecular mass Mc between crosslinking sites in a molecular structure of the detection window is less than 500.

13. A polishing method, suitable for polishing an object, the polishing method comprising:

providing the polishing pad as claimed in claim 1;

applying a pressure on the object to press the object onto the polishing pad; and relatively moving the object and the polishing pad.

14. A polishing method, suitable for polishing an object, the polishing method comprising:

providing the polishing pad as claimed in claim 5;

applying a pressure on the object to press the object onto the polishing pad; and relatively moving the object and the polishing pad.

15. A polishing method, suitable for polishing an object, the polishing method comprising:

providing the polishing pad as claimed in claim 9;

applying a pressure on the object to press the object onto the polishing pad; and relatively moving the object and the polishing pad.

* * * * *